US010468803B1

(12) United States Patent
Beckert

(10) Patent No.: US 10,468,803 B1
(45) Date of Patent: Nov. 5, 2019

(54) OFFSET TUNING FORK CONTACT TERMINALS AND METHODS OF FORMING THEREOF

(71) Applicant: Littelfuse, Inc., Chicago, IL (US)

(72) Inventor: James J. Beckert, Rolling Meadows, IL (US)

(73) Assignee: LITTELFUSE, INC., Chicago, IL (US)

( * ) Notice: Subject to any disclaimer, the term of this patent is extended or adjusted under 35 U.S.C. 154(b) by 0 days.

(21) Appl. No.: 16/138,916

(22) Filed: Sep. 21, 2018

(51) Int. Cl.
*H01R 13/11* (2006.01)

(52) U.S. Cl.
CPC ..... *H01R 13/112* (2013.01); *H01R 13/113* (2013.01)

(58) Field of Classification Search
CPC ..... H01H 85/0026; H01H 85/2015; H01H 85/2035; H01H 85/204; H01H 85/0456; H01H 85/50
USPC ..... 337/187, 198, 161; 439/620.26, 0.34
See application file for complete search history.

(56) References Cited

U.S. PATENT DOCUMENTS

| | | | | |
|---|---|---|---|---|
| 2,186,813 | A * | 1/1940 | Adam | H01H 9/102 337/210 |
| 5,715,135 | A | 2/1998 | Brussalis et al. | |
| 5,883,561 | A * | 3/1999 | Nakamura | H01H 85/0417 337/159 |
| 7,840,243 | B2 | 11/2010 | Hirai | |
| 8,221,165 | B2 * | 7/2012 | DeWitte | H01R 13/688 439/620.26 |
| 8,634,200 | B2 | 1/2014 | Togashi | |
| 2001/0051510 | A1 | 12/2001 | Nakamura | |
| 2003/0100228 | A1 | 5/2003 | Bungo et al. | |
| 2003/0156005 | A1 * | 8/2003 | Ohashi | H01H 85/055 337/160 |

* cited by examiner

*Primary Examiner* — Hien D Vu

(57) ABSTRACT

An electrical terminal contact may include a first tuning fork terminal extendable along a first axis, and may include a first prong and a second prong both extending from a joined first end to respective distal ends. The first end may have a first curvature transitioning to extend along a second axis substantially perpendicular to the first and second prongs. A second tuning fork terminal may be extendable along the first axis, and a third prong and a fourth prong may both extend from a joined second end to respective distal ends. The second end may have a second curvature transitioning to extend along the second axis substantially perpendicular to the third and fourth prongs. The first curvature of the first end and the second curvature of the second end may offset the respective first and second tuning fork terminals from each other along the second axis.

18 Claims, 8 Drawing Sheets

OFFSET TUNING FORK CONTACT TERMINALS AND METHODS OF FORMING THEREOF

FIELD OF THE DISCLOSURE

Embodiments of the present disclosure relate generally to terminal electrical contacts, and more particularly to electrical contacts in cartridge fuses.

BACKGROUND OF THE DISCLOSURE

Fuses in automotive applications, such as cartridge fuses, may include fuse terminals having a plurality of fingers, or prongs. A pair of terminals may typically be incorporated into a fuse cartridge for contact with the circuit board when connected. In some applications, for example, where high currents may be needed, a wider blade may be desirable for increasing cross-sectional area to improve resistance. However, side-by-side terminals may limit a width of the prongs. Prongs having less widths may have lower strength and may be susceptible to deformation and/or failure during assembly or operation. Additionally, the terminals may require isolation from each other, e.g., such that walls or other formations in a plastic housing may be necessary, thereby increasing cost, complexity, and/or size of the fuse.

It is with respect to these and other considerations that the present improvements may be useful.

SUMMARY

This Summary is provided to introduce a selection of concepts in a simplified form that are further described below in the Detailed Description. This Summary is not intended to identify key features or essential features of the claimed subject matter, nor is it intended as an aid in determining the scope of the claimed subject matter.

According to an exemplary embodiment of the present disclosure, an electrical terminal contact may include a first tuning fork terminal extendable along a first axis, which may include a first prong and a second prong both extending from a joined first end to respective distal ends. The first end may have a first curvature transitioning to extend along a second axis substantially perpendicular to the first and second prongs. A second tuning fork terminal may be extendable along the first axis, and may include a third prong and a fourth prong both extending from a joined second end to respective distal ends. The second end may have a second curvature transitioning to extend along the second axis substantially perpendicular to the third and fourth prongs. A fusible link may connect the first end of the first tuning fork to the second end of the second tuning fork. The first curvature of the first end and the second curvature of the second end may offset the respective first and second tuning fork terminals from each other along the second axis.

In various of the foregoing and other embodiments of the present disclosure, the first prong and the second prong may form a first gap therebetween for receiving a blade. The first prong may have a first width along a third axis substantially perpendicular to the first and second axes, and the second prong may have a second width along the third axis substantially perpendicular to the first and second axes. The first width and the second width may be constant. The first prong and the second prong may be flexible to deflect away from each other and outward from the first gap such that at least a portion of the first gap is enlarged for receiving the blade. A first spring force may maintain the blade in the first gap between the first and second prongs. The third prong and the fourth prong may form a second gap therebetween for receiving a blade. The third prong may have a third width along a third axis substantially perpendicular to the first and second axes. The fourth prong may have a fourth width along the third axis substantially perpendicular to the first and second axes. The third width and the fourth width may be constant. The third prong and the fourth prong may be flexible to deflect away from each other and outward from the second gap such that at least a portion of the second gap is enlarged for receiving the blade. A second spring force may maintain the blade in the second gap between the third and fourth prongs. A first protrusion may be disposed on the distal end of the first prong and extending toward the first gap, and a second protrusion may be disposed on the distal end of the second prong and extending toward the first gap. A third protrusion may be disposed on the distal end of the third prong and extending toward the second gap. A fourth protrusion may be disposed on the distal end of the second prong and extending toward the second gap.

According to an exemplary embodiment of the present disclosure, an electrical terminal contact may include a first tuning fork terminal extendable on a first plane, and a second tuning fork terminal extendable on a second plane. The first and second planes may be parallel and offset from each other.

In various of the foregoing and other embodiments of the present disclosure, the first tuning fork terminal may include prongs forming a first gap therebetween, and the second tuning fork terminal may include prongs forming a second gap therebetween. The first tuning fork terminal and the second tuning fork terminal may be connectable via a fusible link, and the fusible link may include one or more curvatures. The prongs of the first tuning fork terminal and the second tuning fork terminal may have a constant width. The prongs of the first tuning fork terminal and the second tuning fork terminal may have protrusions formed on respective inner surfaces towards the respective first and second gaps.

According to an exemplary embodiment of the present disclosure, a method of forming an electrical terminal contact may include forming a first tuning fork terminal having a first prong and a second prong both extending from joined a first end along a first axis, and forming a second tuning fork terminal having a third prong and a fourth prong both extending from a joined second end along the first axis. The first and second ends may be connected by a fusible link. The first and second ends may have respective curvatures for transitioning to extend along a second axis, and the second axis may be substantially perpendicular to the first axis. The respective curvatures of the first and second ends may offset the first and second tuning fork terminals from each other along the second axis.

In various of the foregoing and other embodiments of the present disclosure, the first tuning fork terminal may include prongs forming a first gap therebetween, and the second tuning fork terminal may include prongs forming a second gap therebetween. The prongs of the first tuning fork terminal and the second tuning fork terminal may have a constant width. The prongs of the first tuning fork terminal and the second tuning fork terminal may have protrusions formed on respective inner surfaces towards the respective first and second gaps.

BRIEF DESCRIPTION OF THE DRAWINGS

By way of example, specific embodiments of the disclosed device will now be described, with reference to the accompanying drawings, in which.

DETAILED DESCRIPTION

Figure 1:
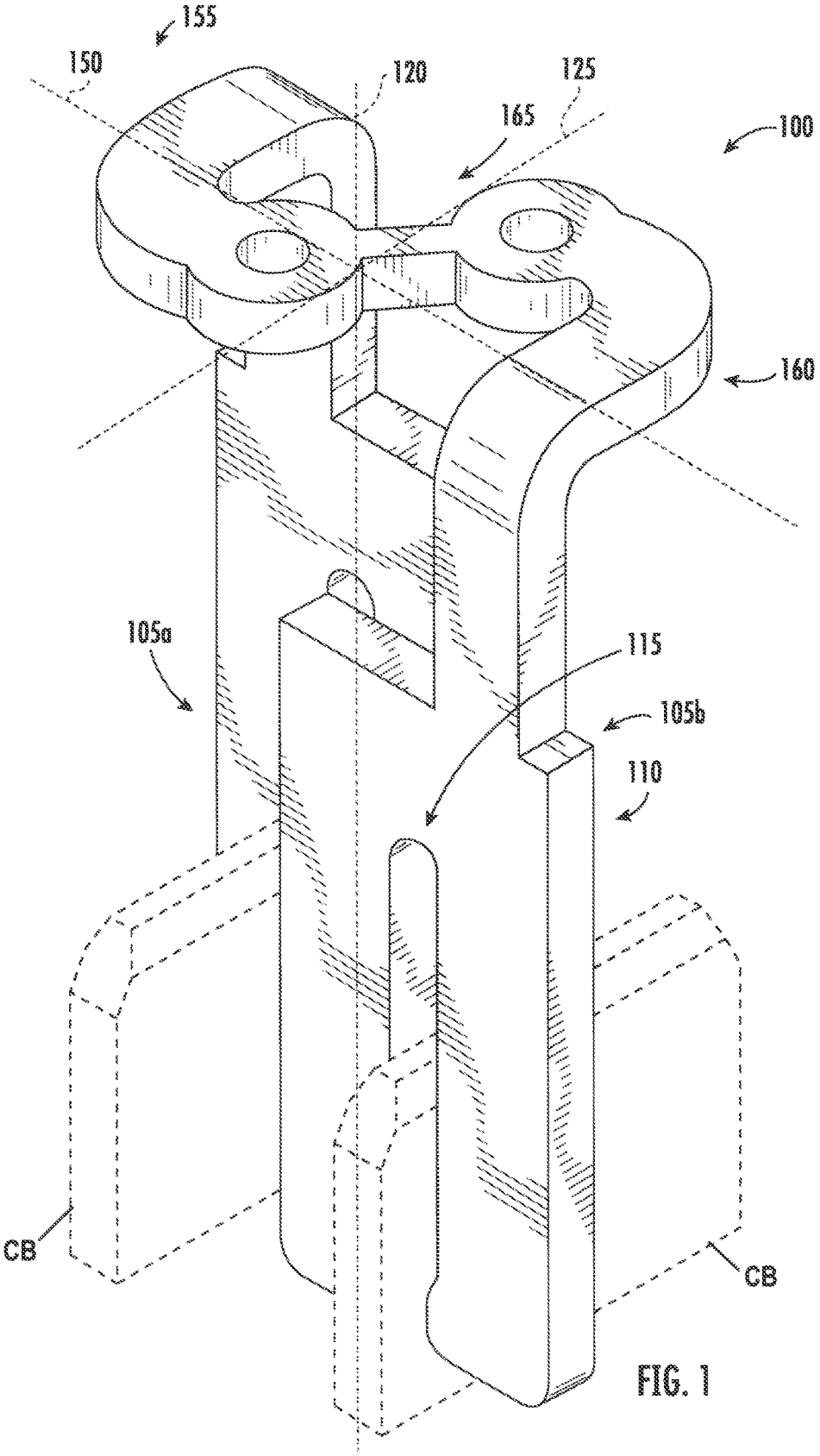
FIG. 1 is a perspective view illustrating an exemplary embodiment of offset contact terminals in accordance with the present disclosure.

The present embodiments will now be described more fully hereinafter with reference to the accompanying drawings, in which several exemplary embodiments are shown. The subject matter of the present disclosure, however, may be embodied in many different forms and types of methods and devices, and should not be construed as limited to the embodiments set forth herein. Rather, these embodiments are provided so that this disclosure will be thorough and complete, and willfully convey the scope of the subject matter to those skilled in the art. In the drawings, like numbers refer to like elements throughout.

FIG. 1 shows a perspective view of offset contact terminals 100 in accordance with an exemplary embodiment of the present disclosure. The offset contact terminals 100 may include one or more tuning fork terminal ends 105, e.g., a first tuning fork terminal end 105*a* and a second tuning fork terminal end 105*b*. It is understood that the offset contact terminals 100 may include any number "n" of tuning fork terminal ends, e.g., 105*a*, 105*b*, . . . 105*n*. Each tuning fork terminal end 105*a*, 105*b* may include a plurality of fingers, or prongs 110 and forming a respective first and second gap 115*a*, 115*b*. The first and second gaps 115*a*, 115*b* may have a respective spacing "G1" and "G2" when in an unconstrained position (e.g., prior to insertion of circuit board components such as a blade "CB" to the tuning fork terminal ends). The spacing G1 and G2 may be the same or the spacing G1 and G2 may be different. The spacing may be sized to accommodate blades CB accordingly depending on the application. In embodiments, the first and/or second gaps 115*a*, 115*b* may have a constant width G1, G2. In some embodiments, in response to receiving blade CB, the respective first and/or second gaps 115*a*, 115*b* may have variable widths G1, G2 from the proximal end to the distal end. For example, the prongs may expand at the distal ends along the third axis 150 to receive blade CB, while the proximal end of the prongs remain stationary.

The tuning fork terminal ends 105*a*, 105*b* may be extendable along a first axis 120, and as will be described below, the tuning fork terminal ends 105*a*, 105*b* may be offset from each other with respect to a second axis 125. The first axis 120 may be substantially perpendicular to the second axis 125, e.g., 90°±10°. The offset contact terminals 100 may be formed of a conductive material, including but not limited to copper, copper alloys, stainless steel, and the like. In embodiments, the offset contact terminals 100 may be formed by stamping, laser cutting, or other known forming processes.

In some embodiments, a first terminal end 105*a* may be disposed on and extendable along a first plane 200, and a second terminal end 105*b* may be disposed on an extendable along a second plane 205. The first plane 200 and the second plane 205 may be parallel to each other, and may be offset from each other (see FIGS. 2B, 3B). The first plane 200 may be substantially parallel to the first terminal end 105*a*, and the second plane 205 may be substantially parallel to the second terminal 105*b*. It is understood that side views of the respective planes 200, 205 (e.g., the first plane 200 and the second plane 205 in FIG. 3B) are shown as double lines for illustration purposes.

Figure 2A:
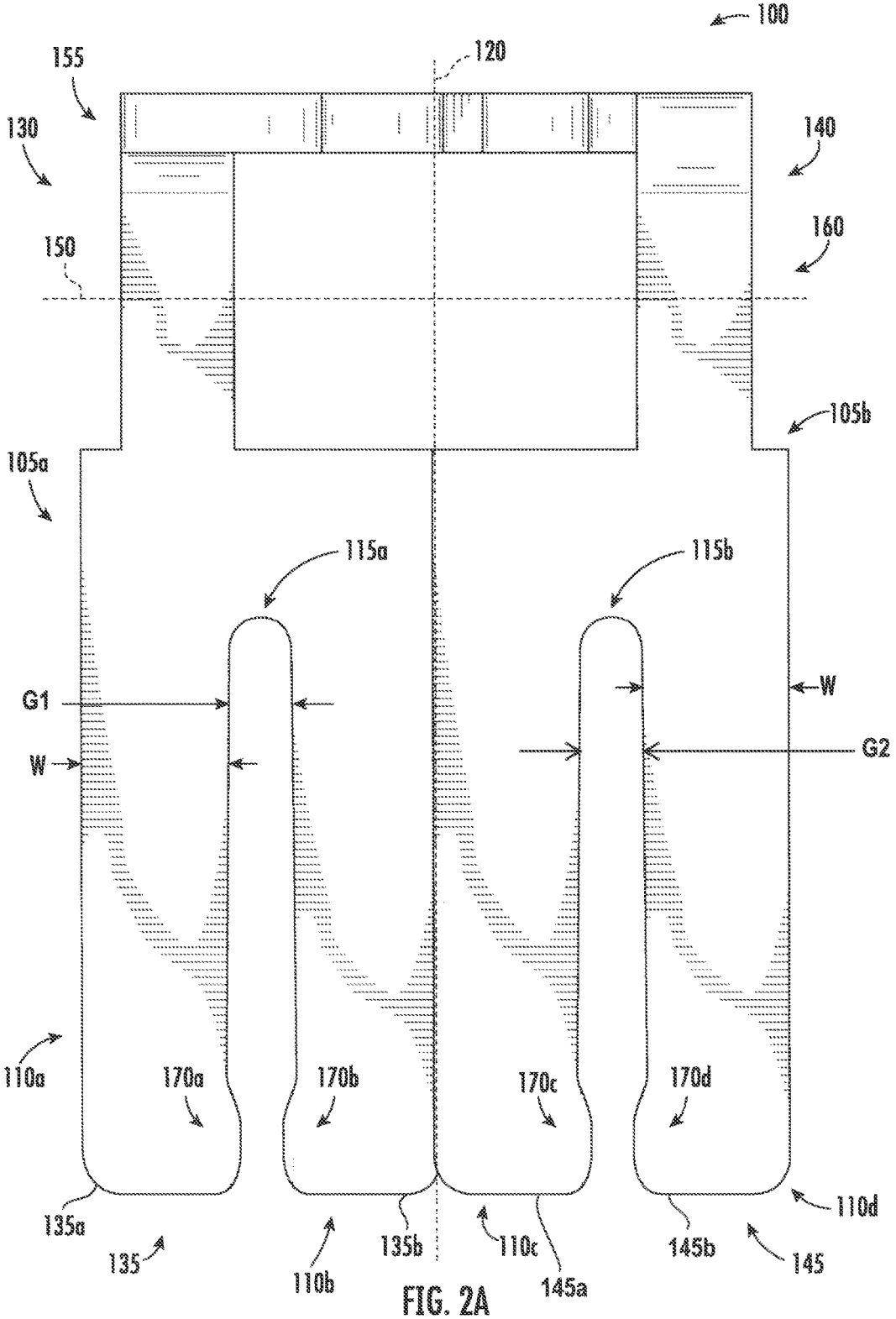
FIGS. 2A-2B are front and back views illustrating an exemplary embodiment of the offset contact terminals shown in FIG. 1.
Figure 2B:
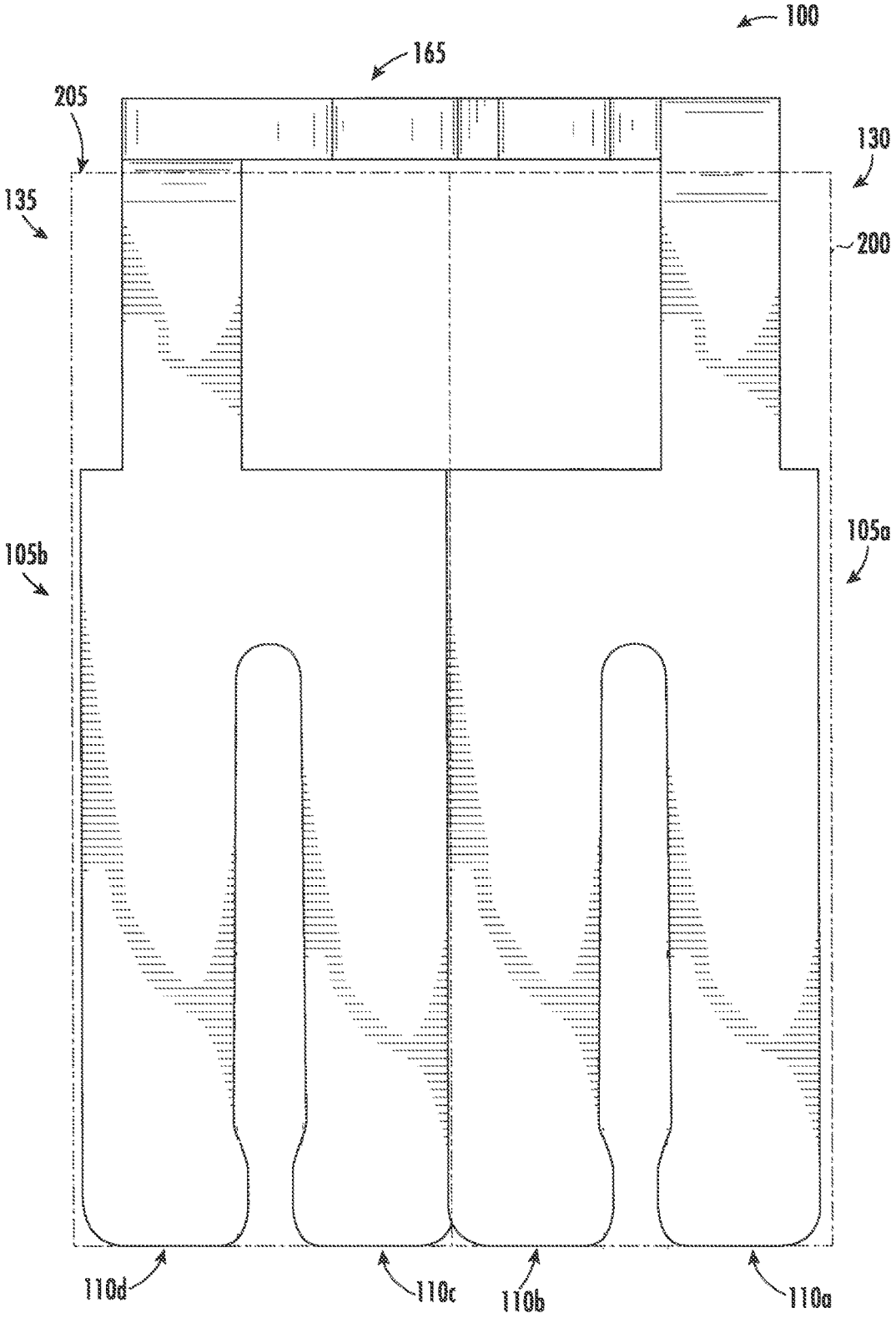

Referring now to FIGS. 2A-2B, a first tuning fork terminal end 105*a* may include a first prong 110*a* and a second prong 110*b*, and a second tuning fork terminal end 105*b* may include a third prong 110*c* and a fourth prong 110*d*. The first tuning fork terminal end 105*a* may extend along the first axis 120 from a first proximal end 130 to respective first distal ends 135 of each prong 110*a*, 110*b*. The second tuning fork terminal end 105*b* may extend along the first axis 120 from a second proximal end 140 to respective second distal ends 145 of each prong 110*c*, 110*d*.

The tuning fork terminal ends 105 may have a joined proximal end and individual prongs at a distal end, thereby forming a respective gap. In embodiments, the first and second prongs 110*a*, 110*b* may be joined together at the first proximal end 130 to form the first tuning fork terminal end 105*a*, and the third and fourth prongs 110*c*, 110*d* may be joined together at the second proximal end 140 to form the second tuning fork terminal end 105*b*.

In some embodiments, the terminal ends 105*a*, 105*b* may be configured to receive a component substantially similar to a tuning fork rotated 90°, so that the respective gaps mate together, as described co-pending application filed concurrently, entitled "Devices, Systems, and Methods for Increasing Terminal Electrical Contact", (application Ser. No. 16/138,922), which is herein incorporated by reference in its entirety.

The first, second, third, and fourth prongs 110*a*-110*d* may have a width "W" and may be equal or different widths. The width W of each prong 110*a*-110*d* may be along a third axis 150, which may be substantially perpendicular (e.g., 90°±10°) to both of the first axis 120 and the second axis 125. In some embodiments, a width of the first and second prongs 110*a*, 110*b* may be equal to each other (e.g., W1), and a width of the third and fourth prongs 110*c*, 110*d* may be equal to each other (e.g., W2), and W1 and W2 may be different from each other. In some embodiments, a first terminal end 105*a* having prong widths different from a second terminal end 105*b* may be desirable for accommodating different connections.

In embodiments, the widths W of any of the first, second, third, and/or fourth prongs 110*a*-110*d* may be constant along the first axis 120. In some embodiments, the widths W of any of the first, second, third, and/or fourth prongs 110*a*-110*d* may be variable along the first axis 120. For example, a width of a prong may be wider at a distal end than at a proximal end. It is understood that the widths of any of the prongs 110*a*-110*d* may be variable to complement the respective gap width (e.g., G1, G2) along the prong 110*a*-110*d*.

The first proximal end 130 may include a first curvature 155, and the second proximal end 140 may include a second curvature 160. A curvature may be formed to transition from the tuning fork terminal, which extends along a first axis, to extend along a second axis, which may be substantially perpendicular to the first axis. As shown in FIGS. 3A-3B and 4A-4B, the first curvature 155 may bend at least a portion of the first proximal end 130 of the first tuning fork terminal end 105*a*, to transition from extending along the first axis 120 to the second axis 125. The second curvature 160 may bend at least a portion of the second proximal end 140 of the second tuning fork terminal end 105*b*, to transition from extending along the first axis 120 to the second axis 125. In some embodiments, the first curvature 155 may be connectable to the second curvature 160 via a fusible link 165 along the second axis 125. The fusible link 165 may be any configuration for connecting the first and second curvatures 155, 160, including but not limited to additional curvatures, circular features, and the like (see FIGS. 1, 4A-4B). For example, additional curvatures and/or circular features may connect the first curvature 155 to the second curvature 160 via the fusible link 165, along the third axis 150 (see FIG. 1).

Figure 3A:
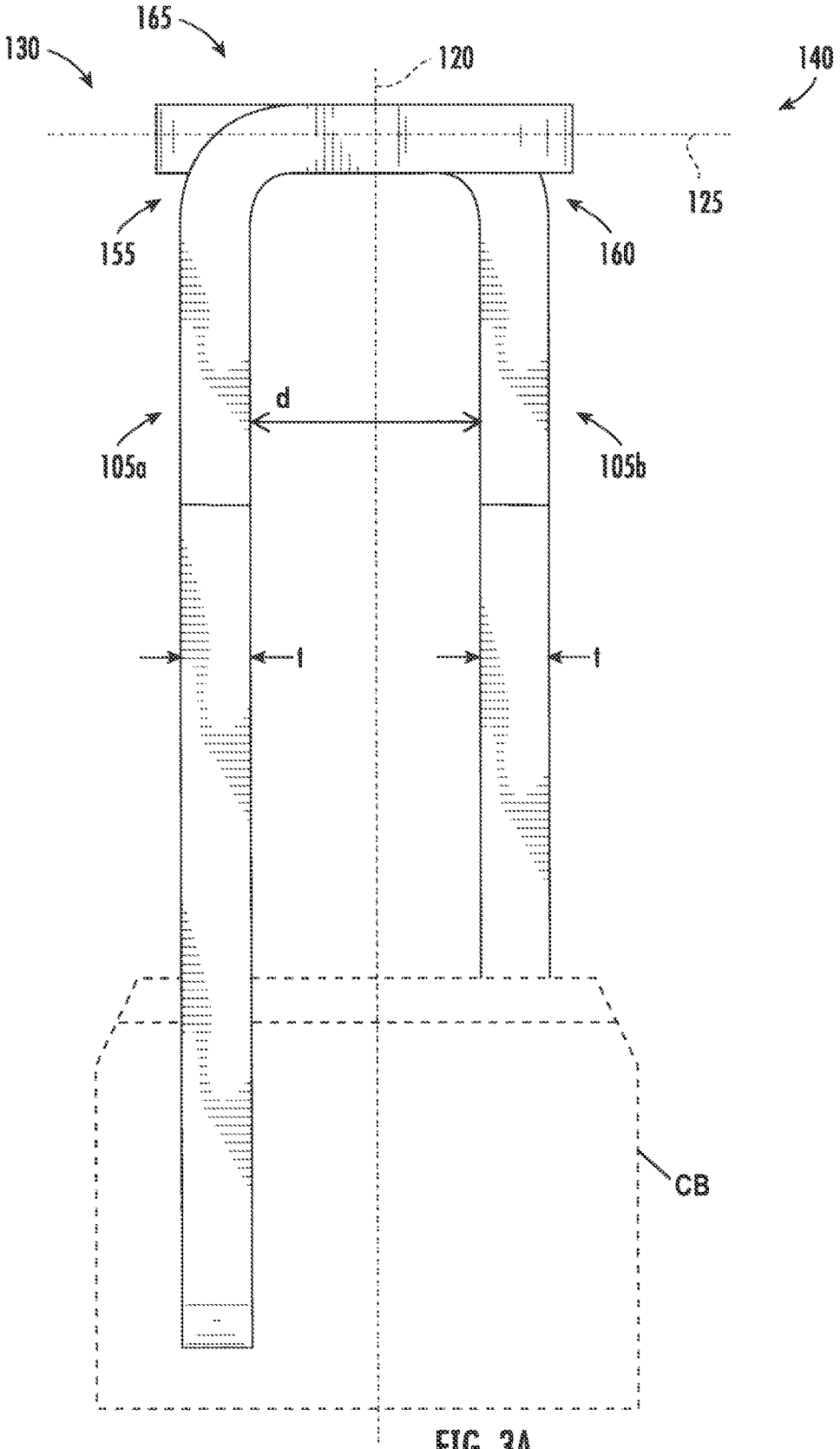
FIGS. 3A-3B are side views illustrating an exemplary embodiment of the offset contact terminals shown in FIG. 1.
Figure 3B:
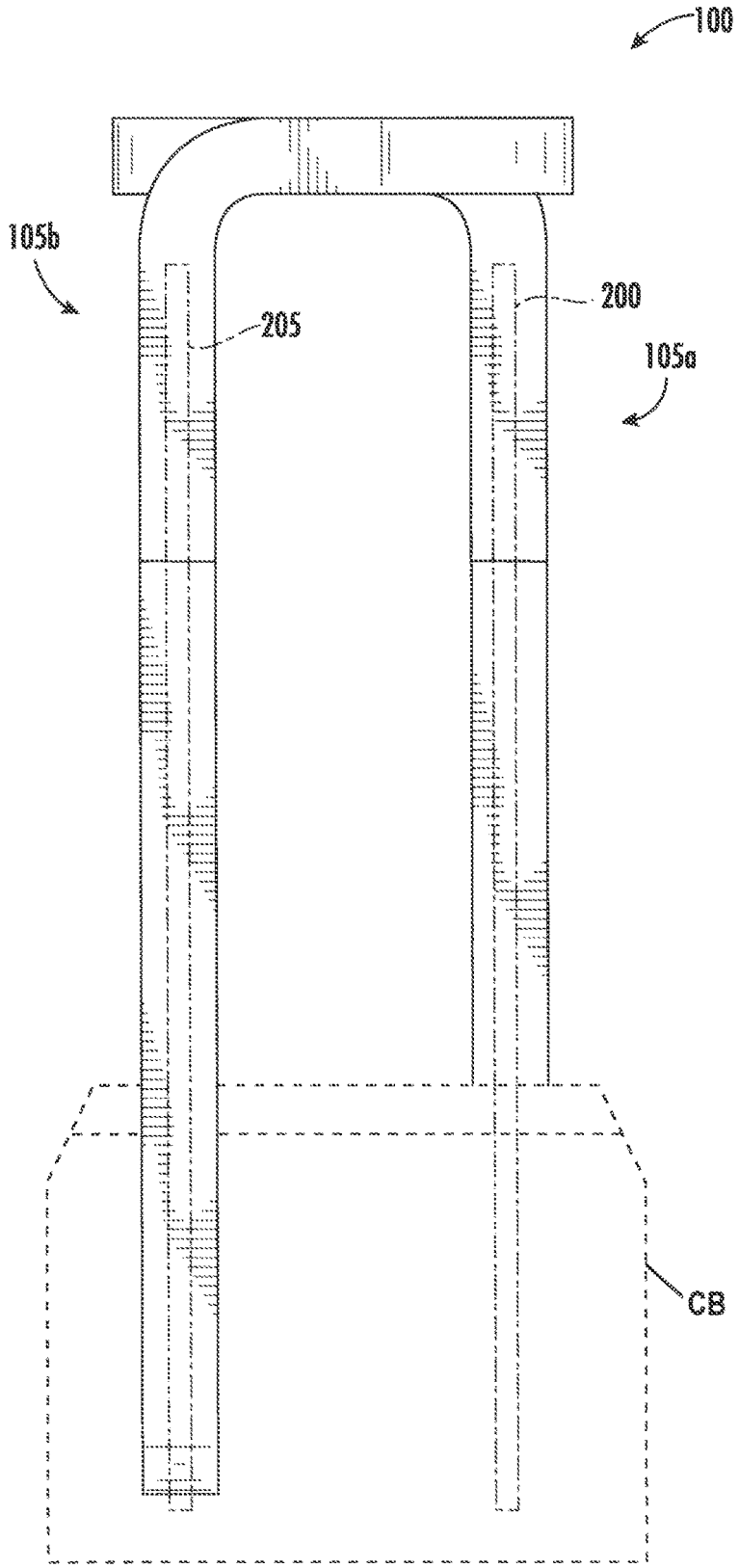
Figure 4A:
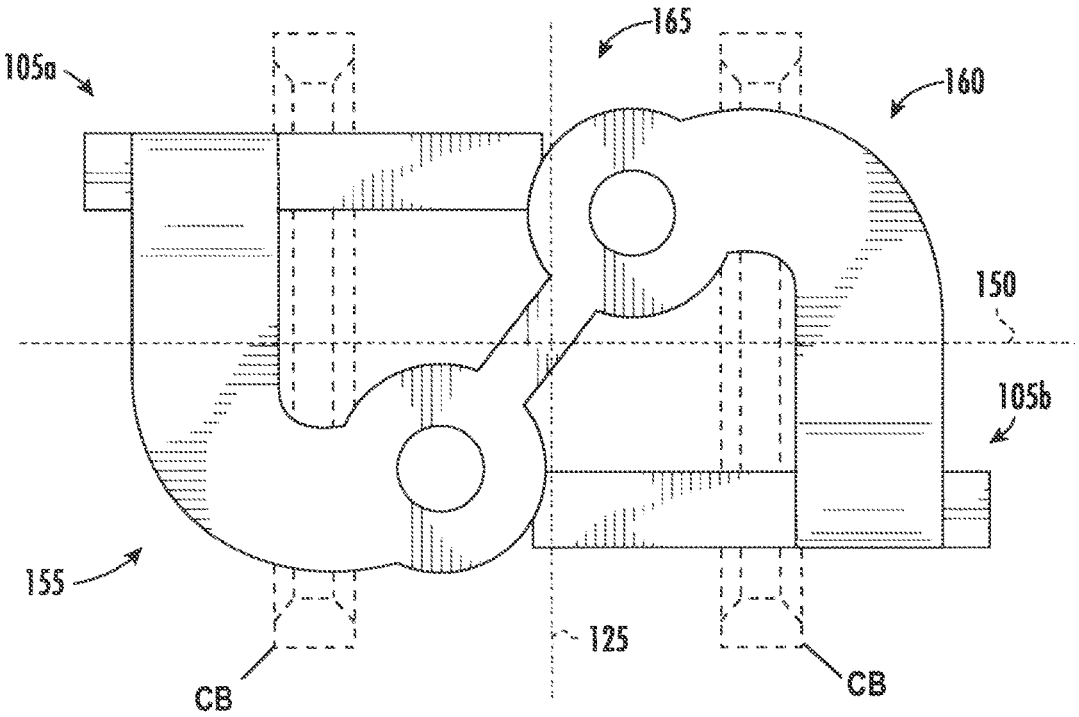
FIG. 4A-4B are top and bottom views illustrating an exemplary embodiment of the offset contact terminals shown in FIG. 1.
Figure 4B:
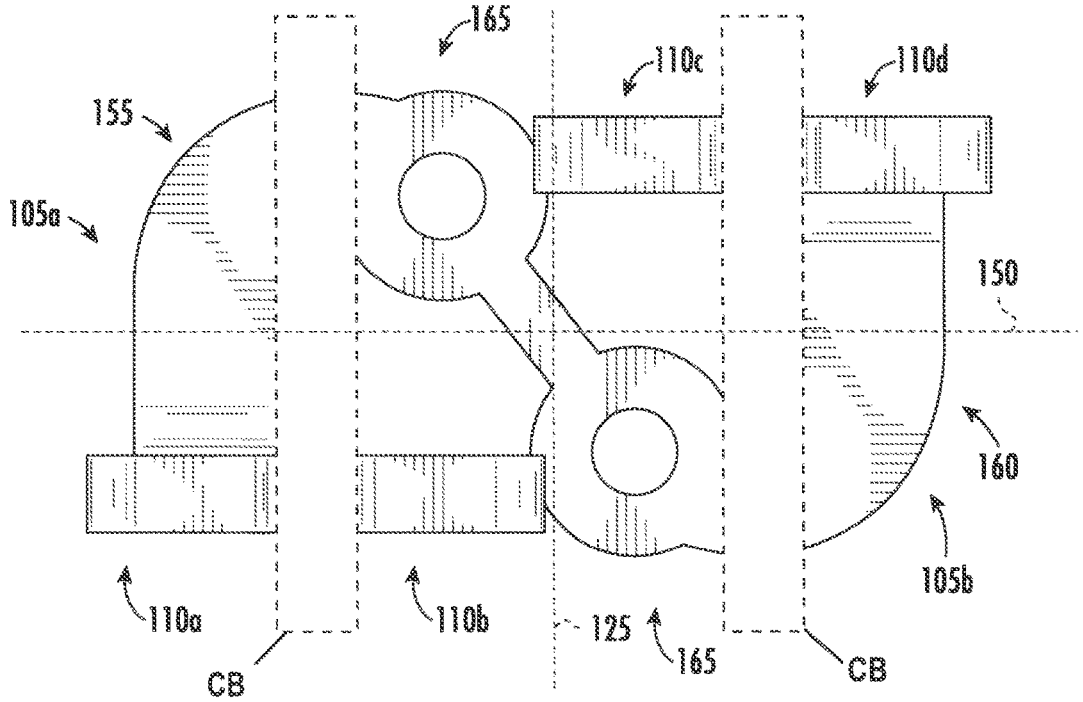

The first and second curvatures 155, 160 may formed so that the first and second tuning fork terminal ends 105*a*, 105*b* may be offset from each other, e.g., a distance "d" apart from each other along the second axis 125. As described above, by offsetting tuning fork terminal ends relative to each other, sufficient clearance may be available for each prong 110*a*-110*d*, e.g., for expansion of the prongs along the third axis 150 to receive blades CB without interference (see FIGS. 5A-5B). As described above, offset tuning fork terminals allow for a respective width of each prong 110*a*-110*d* to be designed for higher electrical current applications without interfering with each other structurally and/or electrically. Additionally, a fuse housing may be more simply designed to accommodate the offset terminal ends. For example, additional separation features between the prongs may not be necessary as electrical interference may not occur with offset terminal ends. As shown in FIGS. 3A-3B, the prongs 110*a*-110*d* may contact circuit board components such as a blade "CB", and in some embodiments, may contact the blade CB off-center. This off-center contact with the blade CB may still provide sufficient electrical conductivity when assembled not significantly different from known side-by-side configurations The first and second tuning fork terminal ends 105*a*, 105*b* may have a thickness "t", and may be equal or different thicknesses. The thickness t of each tuning fork terminal may be along the second axis 125.

Figure 5A:
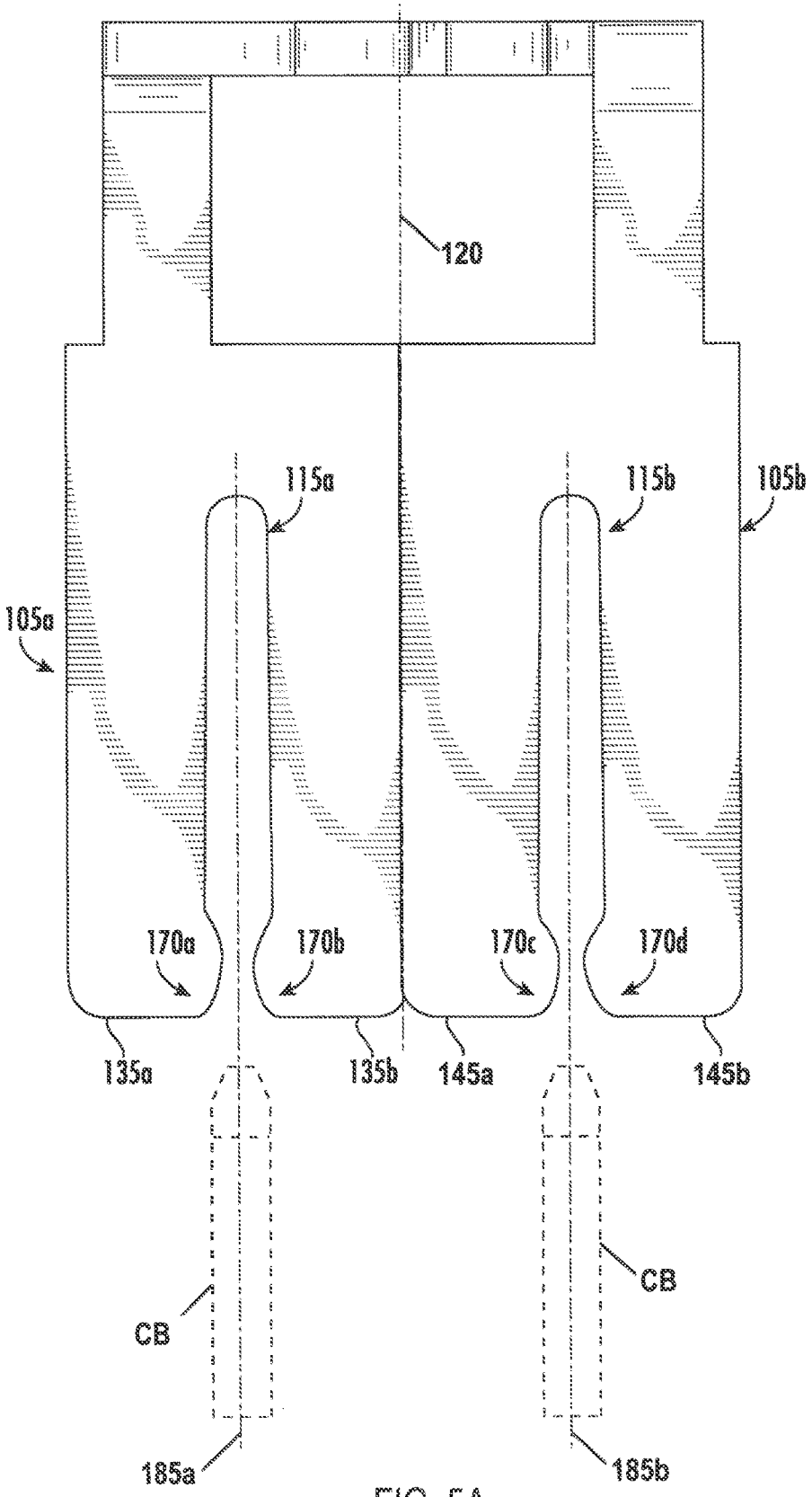
FIGS. 5A-5B illustrate an assembly of an exemplary embodiment of offset contact terminals with blades in accordance with the present disclosure.
Figure 5B:
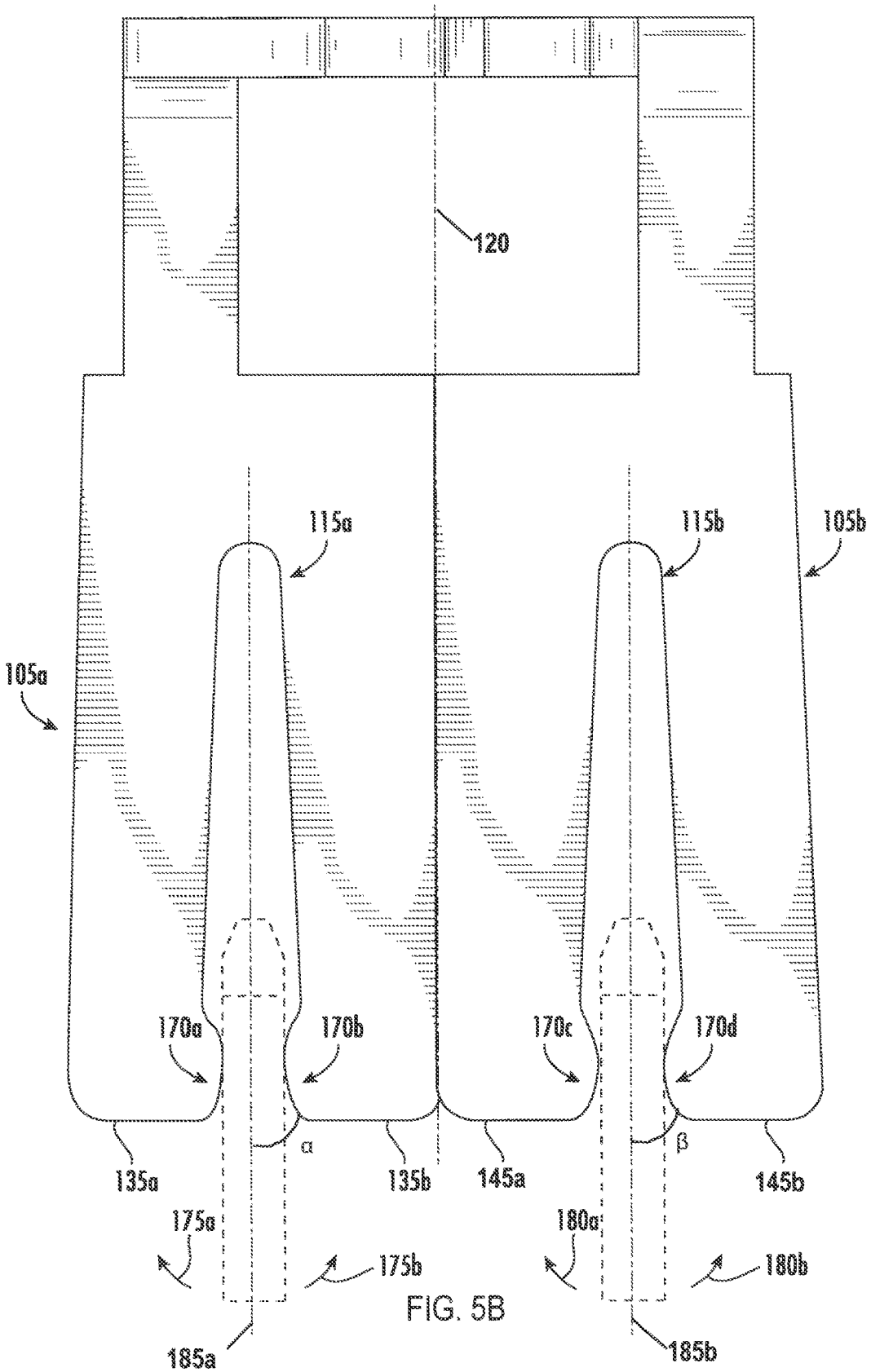

Referring now to FIGS. 5A-5B, an exemplary embodiment of offset contact terminals 100 is illustrated in an unassembled state from a circuit board component such as one or more blades "CB", and in an assembled state.

In some embodiments, a distal end 135*a* of a first prong 110*a* may have a first protrusion 170*a* and a distal end 135*b* of a second prong 110*b* may have a second protrusion 170*b*. Each protrusion 170*a*, 170*b* may be formed inward toward the first gap 115*a* and extending along the third axis 150. A distal end 145*a* of a third prong 110*c* may have a third protrusion 170*c* and a distal end 145*b* of a fourth prong 110*d* may have a fourth protrusion 170*d*. Each protrusion 170*c*, 170*d* may be formed inward toward the second gap 115*b* and extending along the third axis 150. The protrusions 170*a*-170*d* may be any shape, including but not limited to curved, angled, chamfered, filleted, and/or grooved. The protrusions 170*a*-170*d* may provide a contact surface for contacting with circuit board components such as a blade CB. In some embodiments, the protrusions 170*a*-170*d* may be configured to receive a blade CB, such as including lead-in features for easier assembly. For example, the protrusions 170*a*-170*d* may include a tapered lead-in. Contact resistance may be determined by the force generated, the hardness of the material, or the material's electrical resistivity, or combinations thereof.

In an unassembled state, the first and second prongs 110*a*, 110*b* may be static relative to each other, and the third and fourth prongs 110*c*, 110*d* may be static relative to each other. In an assembled state, the first and second prongs 110*a*, 110*b* may be flexible to deflect away from each other and outward from the first gap 115*a* as indicated by arrows 175*a*, 175*b* to receive circuit board components such as a blade CB. The first and second prongs 110*a*, 110*b* may have a spring force such that when a blade CB is received in the first gap 115*a*, the spring force of the first and second prongs 110*a*, 110*b* may maintain the blade in the first gap 115*a*. Similarly, the third and fourth prongs 110*c*, 110*d* may be flexible to deflect away from each other and outward from the second gap 115*b* as indicated by arrows 180*a*, 180*b* to receive circuit board components such as a blade CB. The third and fourth prongs 110*c*, 110*d* may have a spring force such that when a blade CB is received in the second gap 115*b*, the spring force of the third and fourth prongs 110*c*, 110*d* may maintain the blade in the second gap 115*b*.

In embodiments, when the first, second, third, and/or fourth prongs 110*a*-110*d* deflect outward from the respective first and second gaps 115*a*, 115*b*, a first angle $\alpha$ may be formed between a first center line 185*a* of the first gap 115*a*, and a second angle $\beta$ may be formed between a second center line 185*b* of the second gap 115*b*. The angles of deflection of the prongs 110*a*-110*d* may be sized to balance a stress or force generated against the blade CB.

As used herein, references to "an embodiment," "an implementation," "an example," and/or equivalents is not intended to be interpreted as excluding the existence of additional embodiments also incorporating the recited features.

The present disclosure is not to be limited in scope by the specific embodiments described herein. Indeed, other various embodiments of and modifications to the present disclosure, in addition to those described herein, will be apparent to those of ordinary skill in the art from the foregoing description and accompanying drawings. Thus, such other embodiments and modifications are intended to fall within the scope of the present disclosure. Furthermore, although the present disclosure has been described herein in the context of a particular implementation in a particular environment for a particular purpose, those of ordinary skill in the art will recognize its usefulness is not limited thereto and the present disclosure can be beneficially implemented in any number of environments for any number of purposes. Thus, the claims set forth below are to be construed in view of the full breadth and spirit of the present disclosure as described herein.

What is claimed is:

1. An electrical terminal contact, comprising:

a first tuning fork terminal extendable along a first axis, and including a first prong and a second prong both extending from a joined first end to respective distal ends, the first end having a first curvature transitioning to extend along a second axis substantially perpendicular to the first and second prongs;

a second tuning fork terminal extendable along the first axis, and including a third prong and a fourth prong both extending from a joined second end to respective distal ends, the second end having a second curvature transitioning to extend along the second axis substantially perpendicular to the third and fourth prongs; and a fusible link connecting the first end of the first tuning fork to the second end of the second tuning fork;

wherein the first curvature of the first end and the second curvature of the second end offset the respective first and second tuning fork terminals from each other along the second axis.

2. The terminal contact according to claim 1, wherein the first prong and the second prong form a first gap therebetween for receiving a blade.

3. The terminal contact according to claim 2, wherein the first prong has a first width along a third axis substantially perpendicular to the first and second axes, and the second prong has a second width along the third axis substantially perpendicular to the first and second axes.

4. The terminal contact according to claim 3, wherein the first width and the second width are constant.

5. The terminal contact according to claim 2, wherein the first prong and the second prong are flexible to deflect away from each other and outward from the first gap such that at least a portion of the first gap is enlarged for receiving the blade, wherein a first spring force maintains the blade in the first gap between the first and second prongs.

6. The terminal contact according to claim 1, wherein the third prong and the fourth prong form a second gap therebetween for receiving a blade.

7. The terminal contact according to claim 6, wherein the third prong has a third width along a third axis substantially perpendicular to the first and second axes, and the fourth prong has a fourth width along the third axis substantially perpendicular to the first and second axes.

8. The terminal contact according to claim 7, wherein the third width and the fourth width are constant.

9. The terminal contact according to claim 6, wherein the third prong and the fourth prong are flexible to deflect away from each other and outward from the second gap such that at least a portion of the second gap is enlarged for receiving the blade, wherein a second spring force maintains the blade in the second gap between the third and fourth prongs.

10. The terminal contact according to claim 2, further comprising a first protrusion disposed on the distal end of the first prong and extending toward the first gap, and a second protrusion disposed on the distal end of the second prong and extending toward the first gap.

11. The terminal contact according to claim 2, further comprising a third protrusion disposed on the distal end of the third prong and extending toward a second gap, and a fourth protrusion disposed on the distal end of the second prong and extending toward the second gap.

12. An electrical terminal contact, comprising:

a first tuning fork terminal extendable on a first plane; and a second tuning fork terminal extendable on a second plane;

wherein the first and second planes are parallel and offset from each other;

wherein the first tuning fork terminal includes prongs forming a first gap therebetween, and the second tuning fork terminal includes prongs forming a second gap therebetween; and wherein the first tuning fork terminal and the second tuning fork terminal are connectable via a fusible link, the fusible link including one or more curvatures that offset from each other.

13. The terminal contact according to claim 12, wherein the prongs of the first tuning fork terminal and the second tuning fork terminal have a constant width.

14. The terminal contact according to claim 12, wherein the prongs of the first tuning fork terminal and the second tuning fork terminal have protrusions formed on respective inner surfaces towards the respective first and second gaps.

15. A method of forming an electrical terminal contact, comprising:

forming a first tuning fork terminal having a first prong and a second prong both extending from joined a first end along a first axis;

forming a second tuning fork terminal having a third prong and a fourth prong both extending from a joined second end along the first axis; and connecting the first and second ends by a fusible link, the first and second ends having respective curvatures for transitioning to extend along a second axis, the second axis being substantially perpendicular to the first axis;

wherein the respective curvatures of the first and second ends offset the first and second tuning fork terminals from each other along the second axis.

16. The method according to claim 15, wherein the first tuning fork terminal includes prongs forming a first gap therebetween, and the second tuning fork terminal includes prongs forming a second gap therebetween.

17. The method according to claim 15, wherein the prongs of the first tuning fork terminal and the second tuning fork terminal have a constant width.

18. The method according to claim 15, wherein the prongs of the first tuning fork terminal and the second tuning fork terminal have protrusions formed on respective inner surfaces towards the respective first and second gaps.

* * * * *